US005178070A

United States Patent [19]

Zorn et al.

[11] Patent Number: 5,178,070

[45] Date of Patent: Jan. 12, 1993

[54] APPARATUS AND METHOD FOR CONTROLLING PRINT TIMING OPERATIONS

[75] Inventors: Donald Zorn, Kitchener; Trevor J. German, Elmire, both of Canada

[73] Assignee: NCR Corporation, Dayton, Ohio

[21] Appl. No.: 776,938

[22] Filed: Oct. 15, 1991

[51] Int. Cl.[5] ..... B41J 1/32

[52] U.S. Cl. ..... 101/486; 101/93.21; 101/93.28; 346/153.1; 400/154.4

[58] Field of Search ..... 101/93.01, 93.09, 93.14, 101/93.17, 93.18, 93.19, 93.2, 93.21, 93.22, 93.28, 486; 400/145.2, 146, 148, 152, 154, 154.4, 162.3, 163.1; 346/153.1

[56] References Cited

U.S. PATENT DOCUMENTS

| | | | |
|---|---|---|---|
| 2,919,967 | 1/1960 | Schwertz | 101/93.21 |
| 3,830,646 | 8/1974 | Chen | 346/153.1 |
| 3,850,097 | 11/1974 | Sweeney | 101/93.09 |
| 3,869,980 | 3/1975 | Schroeder, Jr. | 101/93.21 |
| 4,031,519 | 6/1977 | Findley | 400/63 |
| 4,665,820 | 5/1987 | Chapman | 101/93.14 |
| 4,881,833 | 11/1989 | Seki et al. | 101/93.21 |
| 5,027,702 | 7/1991 | Dragon et al. | 101/93.28 |

FOREIGN PATENT DOCUMENTS

| | | | |
|---|---|---|---|
| 0028337 | 3/1978 | Japan | 101/93.21 |

*Primary Examiner*—Eugene H. Eickholt
*Attorney, Agent, or Firm*—Robert S. Hulse

[57] ABSTRACT

An apparatus and method are disclosed for determining the position and angular velocity of a print drum. The apparatus includes a detector that is positioned proximate to the drum, and a processor coupled to the detector. The drum has a cylindrical body with a plurality of alphanumeric characters and a sequence of marks, including an index mark and a plurality of timing marks uniformly disposed about the circumference of the body, the timing marks being in relative alignment with the characters such that each character is associated with a pair of timing marks. The index mark is used to designate a start or reference location on the body. The detector includes a magnetic field generating source such as a magnet, a magnetic lens for directing the field toward the marks, and a hall effect sensor for detecting (through changes in magnetic field caused by the marks when the drum is rotated) the index mark and respective pairs of the timing marks, and producing a digital signal representative of the detected marks. In response to the digital signal, the processor detects a pair of timing marks and determines the position on the drum of the character associated with the detected pair. The processor also determines the angular velocity of the drum based on frequency of detection of the timing marks.

32 Claims, 5 Drawing Sheets

APPARATUS AND METHOD FOR CONTROLLING PRINT TIMING OPERATIONS

BACKGROUND OF THE INVENTION

This invention relates to printer systems generally, and particularly to timely positioning of print media such as print drums, print disks, and print bands for printing.

Generally, the print medium includes a variety of uniformly arranged characters, and has a corresponding number of timing marks (e.g., vertical bars, slits, etc.) aligned with the characters. Some systems use one sensor with one set of marks to determine positions of the individual characters, others use two sensors (i.e., different sensors with different marks) to determine the positions of individual characters and the velocity of the medium (e.g., the rate of movement of the medium relative to a print head or other sensor).

One such system is described, for example, in U.S. Pat. No. 2,919,967 entitled "High-Speed Electrostatic Alphanumerical Printer" issued Jan. 5, 1960 to F. A. Schwertz. Another such system is described in U.S. Pat. No. 4,665,820 entitled "Print Band Timing Mark Detector", issued May 19, 1987 to W. Chapman. A third such system is described in U.S. Pat. No. 4,815,873 entitled "Initializing Method For Printing Type Rings in Printer", issued Mar. 28, 1989 to F. Hori. A common concern with many such prior art systems is design complexity, with its attendant lower reliability, less compactness, and increased cost of manufacture.

What is needed and would be useful, therefore, is a system (apparatus) of less design complexity, which would be reliable, compact, and cost less to manufacture.

SUMMARY OF THE INVENTION

According to the present invention, a print timing control apparatus is disclosed which can be compact and less complex than prior systems. The apparatus uses a single sequence (column) of timing marks and single sensor in determining both the angular velocity and position of a print medium such as a print drum.

The apparatus includes a detector and a processor. The detector includes a sensor and signal conversion device. The sensor includes a magnet, a magnetic lens, and a hall effect sensing device. The signal conversion device includes a pair of amplifiers and a zero-crossing detection device. The magnet produces a magnetic field proximate to the drum. The drum has a cylindrical body with a plurality of alphanumeric characters and a sequence of marks, including an index mark and several timing marks uniformly disposed about the circumference of the body. The timing marks are in relative alignment with the characters such that each character is associated with a pair of timing marks. The index mark designates a start or reference location on the body.

The detector is responsive to rotation of the drum for detecting the index mark and at least one pair of timing marks, and producing a digital signal representative of the detected marks. The processor is coupled to the detector and responsive to the digital signal for tracking (determining) the position on the drum of the character associated with the detected pair, and determining the angular velocity of the drum based on the elapsed time between detections of the timing marks.

DESCRIPTION OF THE PREFERRED EMBODIMENT

Figure 1:
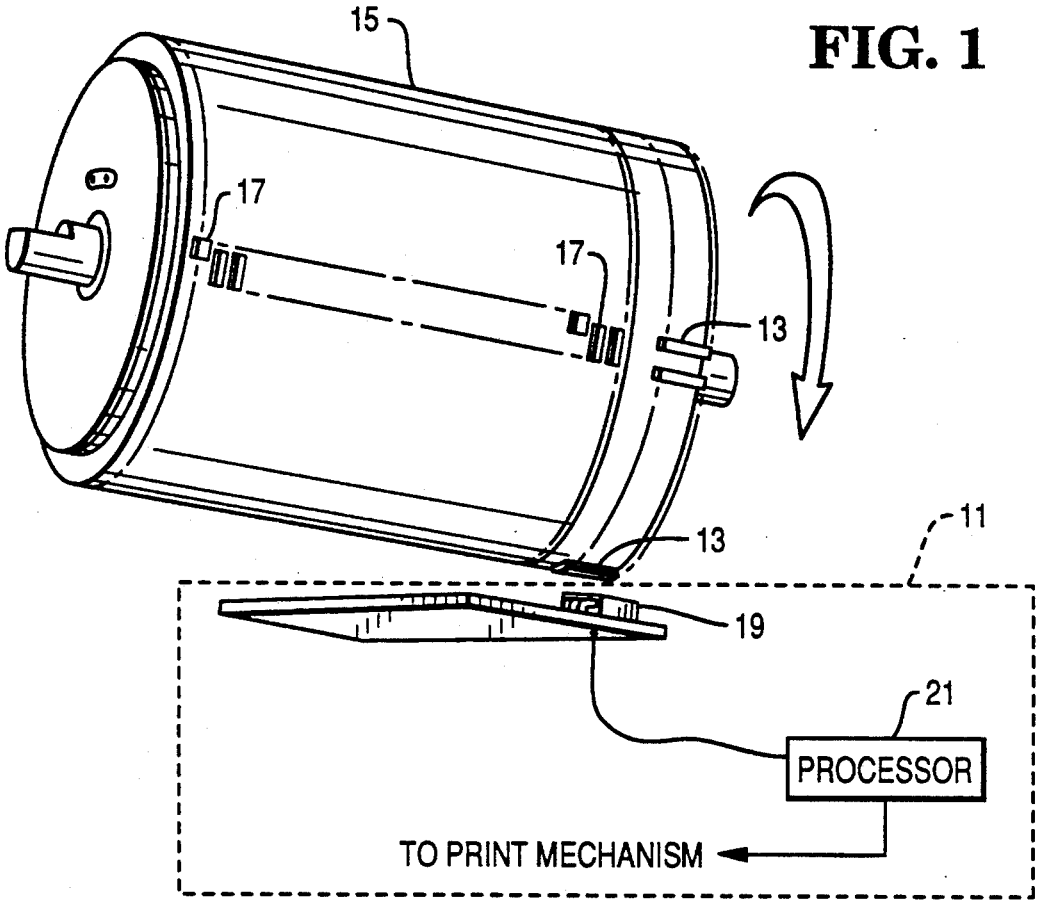
FIG. 1 is a graphic illustration of the apparatus of the present invention.
Figure 2:
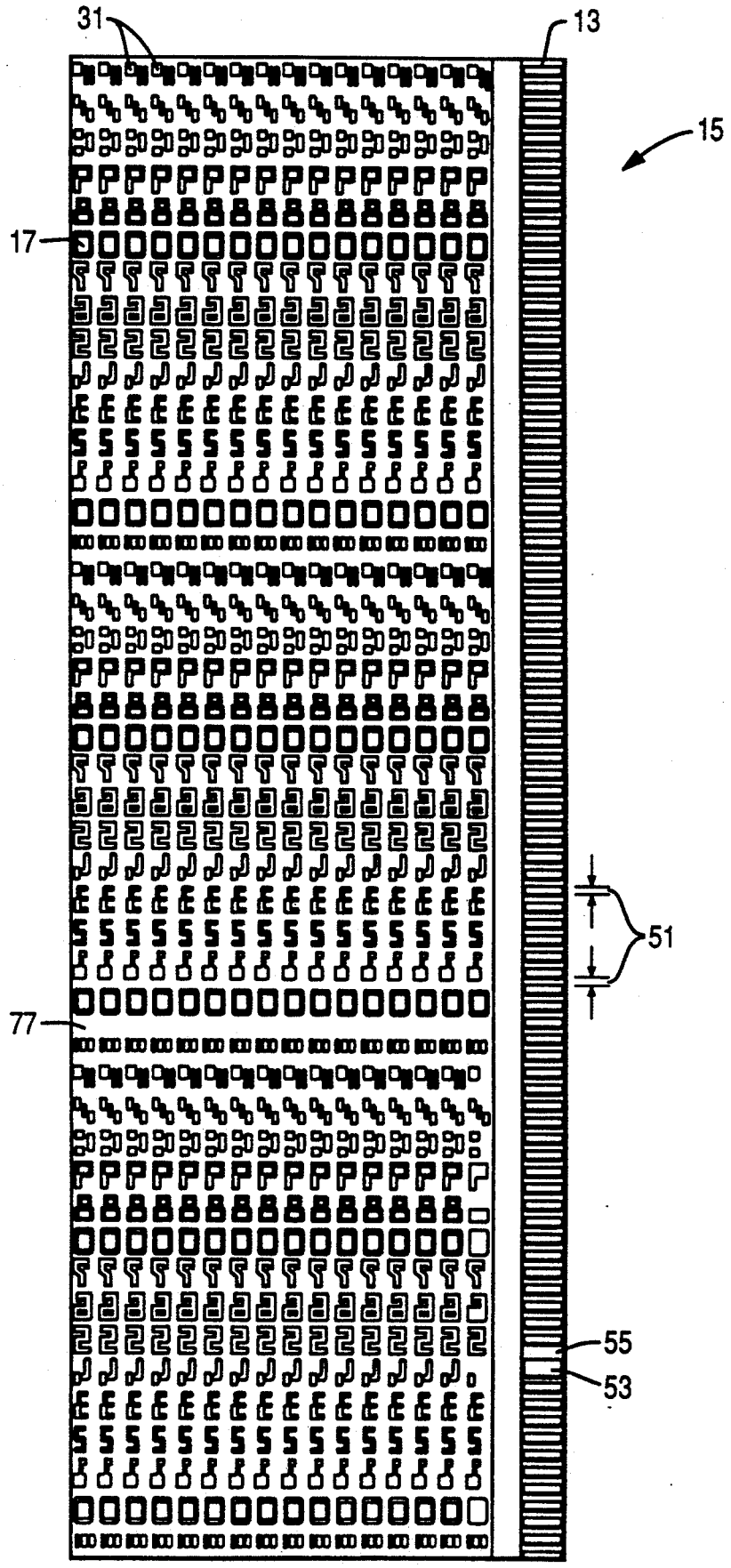
FIG. 2 is a graphic illustration of a print drum, showing various characters and timing marks (including an index mark) used with the apparatus of FIG. 1.

FIG. 1 shows an apparatus 11 of the present invention. The apparatus operates in conjunction with timing marks 13 (e.g., raised bars) arranged uniformly (in sequence) about the periphery and along the edge of a rotatable cylindrical print drum 15. As shown in FIGS. 1 and 2, the print drum includes a plurality of alphanumeric characters 17 disposed about the periphery of the drum, each character arranged so as to be in synchronism with a pair of timing marks. FIG. 2 shows the location of the characters and the timing marks in an "unwrapped" view of the circumference of the print drum.

Figure 3:
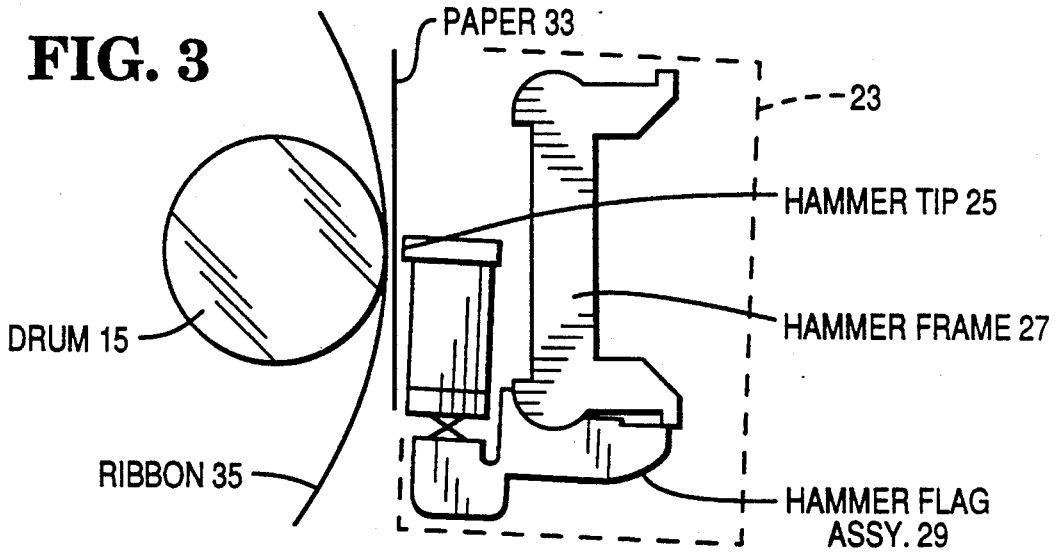
FIG. 3 is a graphic illustration of a print mechanism used with the apparatus of FIG. 1.

The apparatus 11 (FIG. 1) includes a detector 19 and a processor 21. In selecting a character for printing, the processor 21 uses the detector 19 to detect the timing marks associated with (in sync with) the character and, thereby, determines the position the character for printing. The processor 21 then actuates a print mechanism (a hammer of a hammer bank) for printing the positioned character. As shown in FIG. 3, each hammer of the hammer bank 23 includes a hammer tip 25, a hammer frame 27, and a hammer flag assembly 29 for coupling the hammer tip 25 and frame 27. The rotating drum 15 has several (e.g., 16) columns 31 of characters (FIGS. 1 and 2) formed about its circumference, and the hammer bank has individual hammers positioned one per column. A sheet of paper 33 (FIG. 3) and an inked ribbon 35 may be placed between the hammers and the drum. When a selected character is at a calculated angular position ahead of the print position (i.e., the position opposite the hammer tip 25), the hammer is actuated by processor 21. The hammer hits (impacts) the paper and forces it and the ribbon against the drum at the exact point that the moving character passes the print position. As a result of the impact, ink is transferred from the ribbon to the paper in the form of the selected character.

Figure 4B:
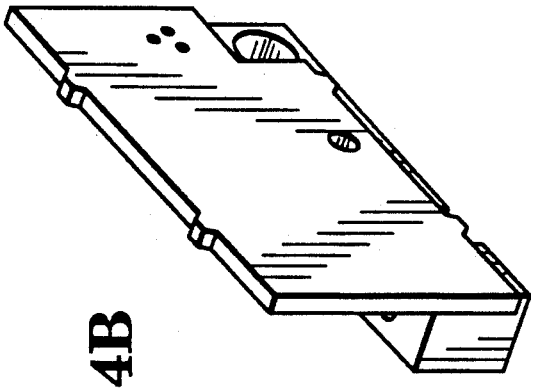
FIGS. 4A–4C are graphic illustrations of a detector, including a magnetic sensor, in the apparatus of FIG. 1.
Figure 4A:
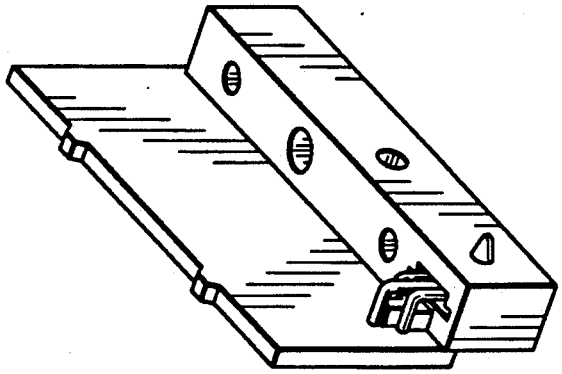
Figure 4C:
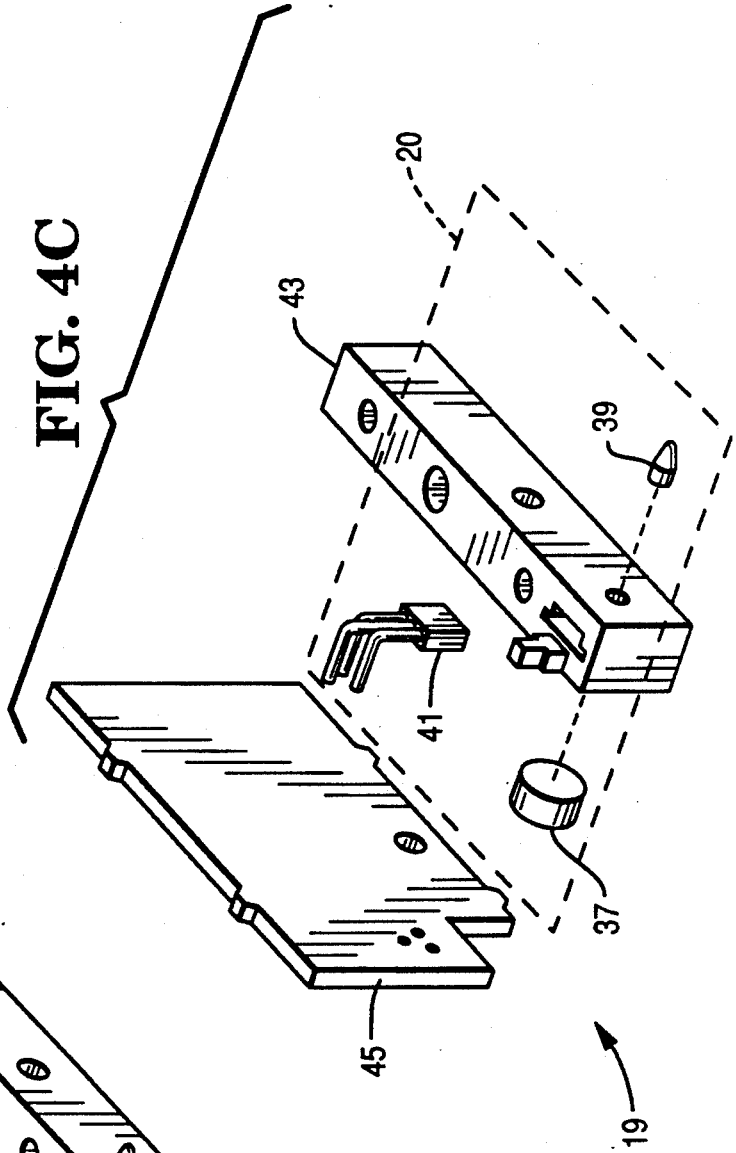

FIGS. 4A–4C show a front, rear, and exploded view of the detector 19. The detector 19 includes a magnetic sensor 20 and a signal converter 22. The sensor 20 includes three components: a magnet 37, a magnetic lens 39, and a hall effect sensing device 41, the three components being mountable on a mounting block 43 and circuit board 45. Through the use of the detector 19 and a single column (sequence) of timing marks 13 (FIG. 2) the processor 21 is able to determine the angular position and velocity of the print drum 15, as described below.

Figure 5:
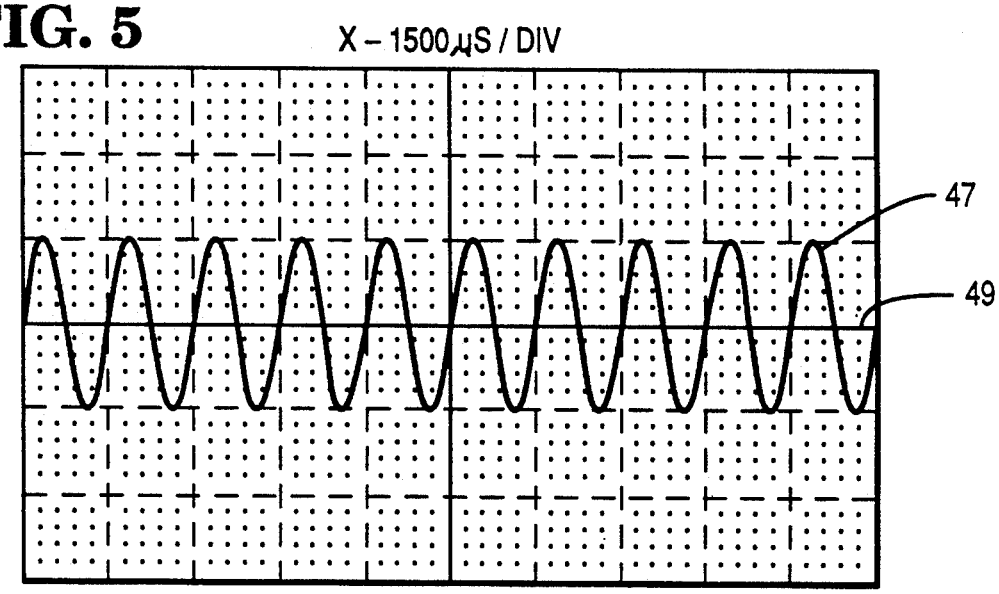
FIG. 5 is a waveform diagram showing a signal produced by the sensor of FIGS. 4A–4C upon detecting the timing marks of FIG. 2.

The magnetic lens 39, which is positioned proximate (e.g., within 0.01") to the timing marks 13, concentrates the flux of the magnet 37 through the hall effect device 41 towards the timing marks 13 on the print drum 15. As the print drum rotates, resistance in the flux path changes, i.e., increases and decreases, as the timing marks 13 pass the magnetic lens 39. The hall effect device 41 converts the changes in flux to an analog electrical signal 47, as shown in FIG. 5. The output signal (waveform) 47 from the hall effect device 41 appears substantially symmetrical about a zero crossing point 49. This symmetry results from the arrangement of the timing marks 13 on the drum 15, namely, the arrangement of two timing marks per character (refer to FIGS. 2 and 1) and a mark-to-space ratio of one (i.e., timing marks and spaces of equal width 51).

Figure 6:
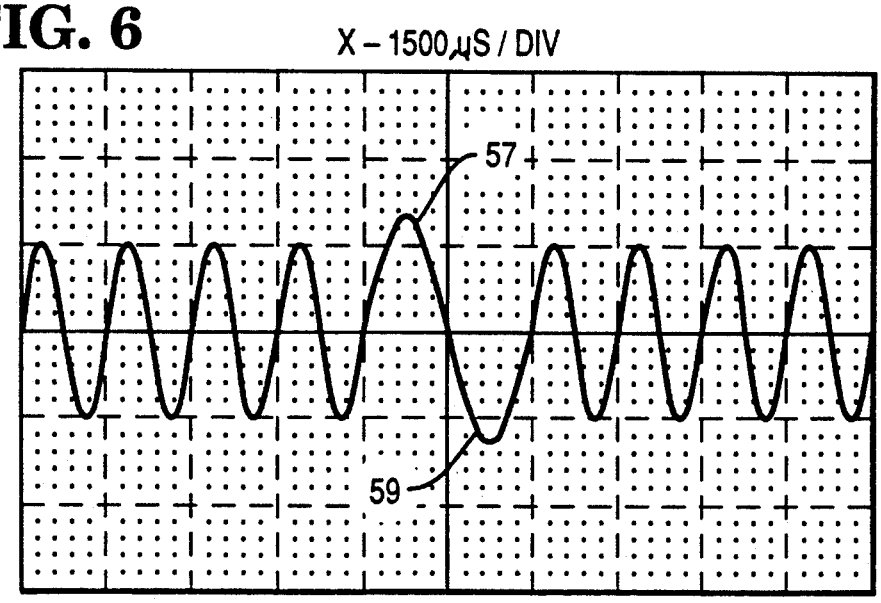
FIG. 6 is a waveform diagram showing a signal including a component produced by the sensor of FIGS. 4A–4C upon detecting the index mark of FIG. 2.
Figure 7:
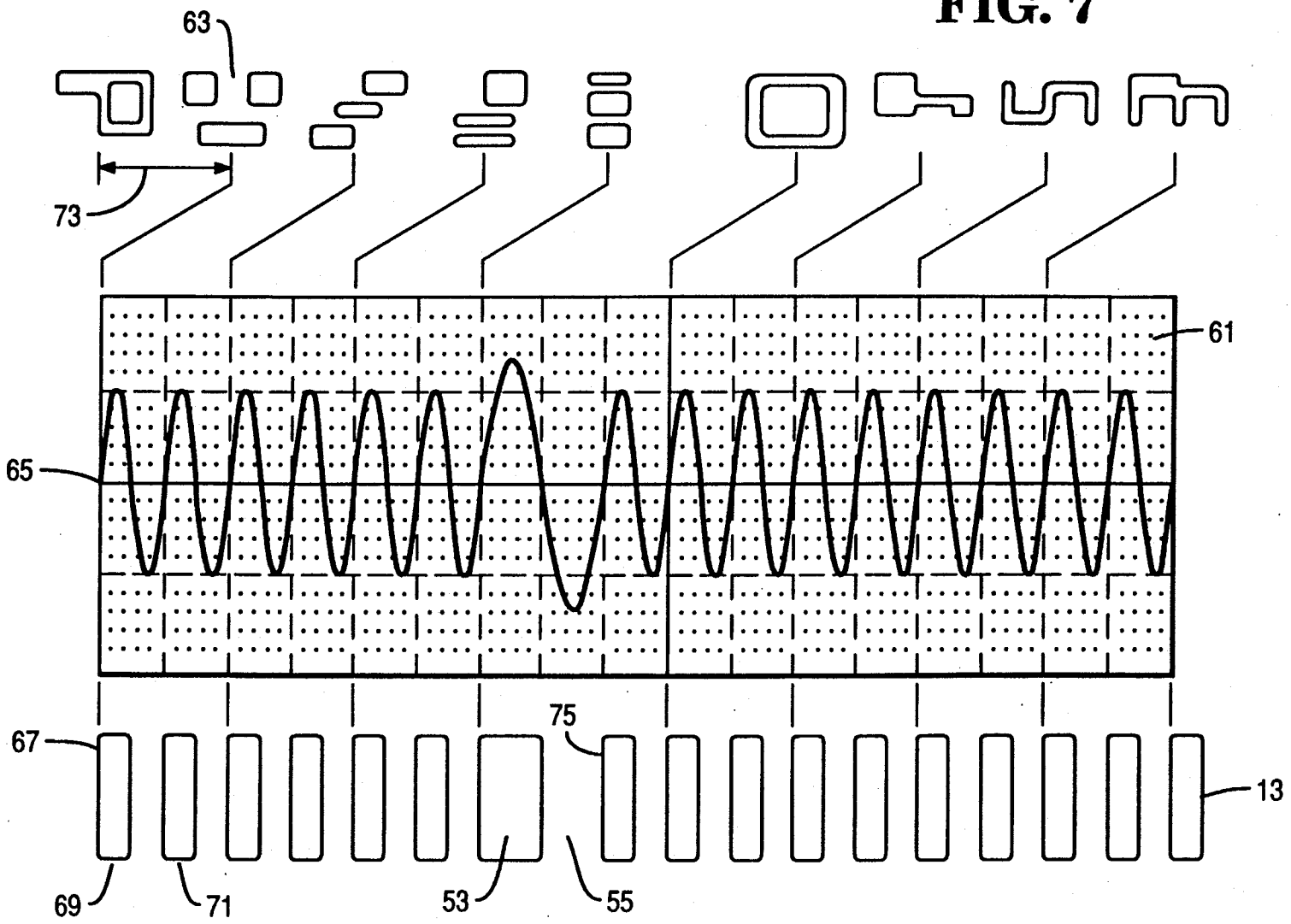
FIG. 7 is a graphic illustration of the relation between index and timing marks, signal (waveform) produced by the sensor, and corresponding positions of characters on the drum.

To enable the processor 21 to determine the angular position of the rotating print drum 15, an index mark 53 is included in the timing marks, as shown in FIGS. 2 and 7. The index mark 53 and the space 55 following it are wider than (e.g., twice as wide as) the other timing marks and spaces. The output signal (waveform) produced by the hall effect device 41 (corresponding to the index and timing marks shown in FIG. 2) is shown in FIG. 6. The portions of the signal contributed by the index mark and space 53, 55 are shown by reference numerals 57, 59 respectively.

FIG. 7 shows in greater detail the index mark 53 and timing marks 13 at the detector position, the resulting output 61 from the hall effect sensing device of the detector, and the corresponding character 63 (at the print position) that is struck by the hammer. After a predetermined delay $\Delta t$ (e.g., 0.82–1.1 milliseconds) from the zero-crossing 65 or rising edge 67 of the timing mark (which precedes, by one character pitch 73, the character-to-be-struck 63), the hammer is fired (actuated). This is done to allow for the flight time of the hammer as it moves from its rest position to its strike position. To allow the signal from the hall effect device 41 to settle down into a regular (symmetrical) waveform before being used (output), the rising edge 75 of the timing mark immediately following the index mark 53 is ignored by the processor 21. The extra ½ pitch character space 77 shown in FIG. 2 corresponds to the ignored timing mark 75.

Figure 8:
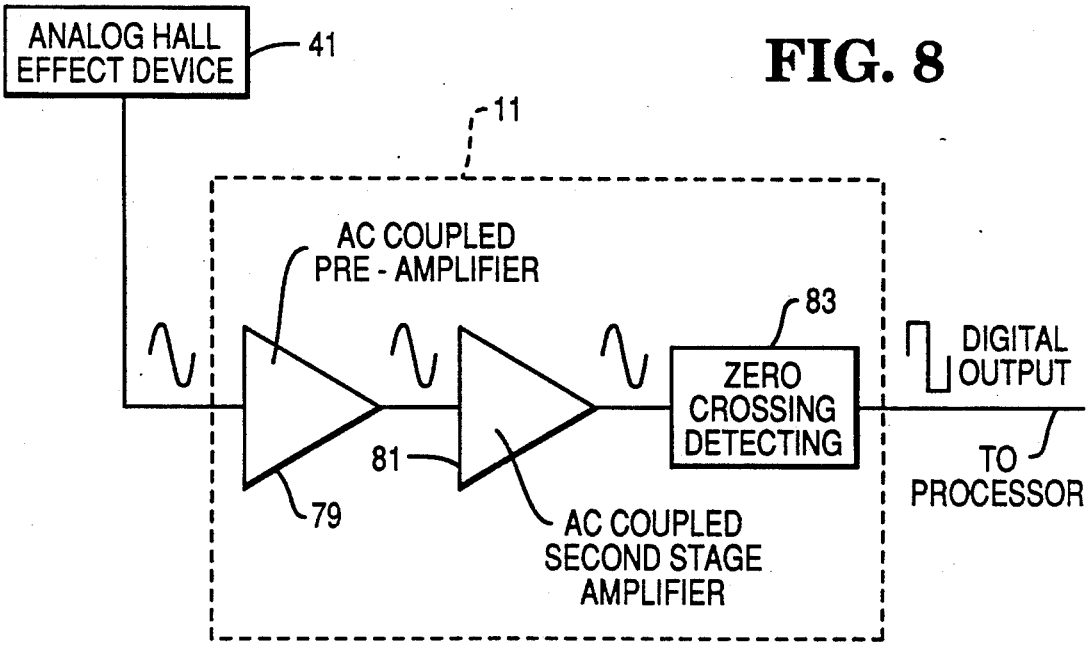
FIG. 8 is a block diagram showing how the signal produced by the sensor is converted to digital form for input to the processor.

Following the production of a symmetrical output signal by the hall effect sensing device 41 of detector 19, the output signal is AC coupled, amplified, and converted to digital form (by signal converter 22, representing standard electronic components 79, 81, 83 on circuit board 45), and applied to processor 21, as shown in FIG. 8. Signal converter 22, which may be mounted on circuit board 45, may include a pre-amplifier 79 and second stage amplifier 81 (e.g., LM358 amplifiers publicly available from National Semiconductor Corporation), and a zero-crossing detector circuit 83 (e.g., LM393 publicly available from National Semiconductor Corporation). In response to the amplified hall effect output signal, the zero-crossing detector detects the onset (initial zero-crossing) of each signal component (corresponding to one timing mark or one period of the waveform), and produces a corresponding digital output signal. Upon rotation of the drum 15, the digital output signals (corresponding to the timing marks) are then counted by the processor 21 (two digital output signals per character) relative to a zero or start position represented by the index mark 53. The count is then used by the processor 21 to access a predetermined table (e.g., Table I below) stored in the processor to determine the character (corresponding to the count and associated timing mark) that is then positioned before the hammer.

TABLE I

| Timing Mark Position Count | Character |
|---|---|
| 1 | None (Timing Mark ignored) |
| 2 | 0 |
| 4 | 1 |
| 6 | 2 |
| . | . |
| . | . |
| . | . |
| 22 | 9 |
| . | . |
| . | . |
| . | . |
| 24 | □ □ □ |
| 30 | □ □ □ |

In addition to determining the position of a character, and hence the position of the drum, the processor 21 also determines the angular velocity (i.e., the speed or rotation rate) of the drums. The processor 21 includes a clock (not shown) for accumulating elapsed time of rotation of the drum. The angular velocity of the drum is calculated by the processor by dividing the distance (0.08 inches approximately) between two consecutive timing marks by the elapsed time between detections of the two consecutive timing marks during rotation of the drum. Alternatively, the angular velocity of the drum may be calculated by dividing the distance corresponding to the circumference of the drum (i.e., the distance form the index mark, around the circumference of the drum, and back to the index mark) by the elapsed time between successive detections of the index mark during rotation of the drum. A desirable drum speed (angular velocity) may correspond to one drum revolution (rotation) every 1.5 milliseconds. Thus, with a single column of timing marks (with index mark) and a single detector and processor, the apparatus is able to measure both the drum speed and drum position.

While the present invention is susceptible of embodiment in various forms (for example, a form reflecting the use of print disks or print bands instead of a print drum, and timing slits or other marks instead of raised timing bars), there is shown in the drawings and described in the specification a presently preferred embodiment, with the understanding that the present disclosure is to be considered as an exemplification of the invention, and is not intended to limit the invention to the specific embodiment illustrated.

What is claimed is:

1. A method of determining the position and angular velocity of a print drum, the drum having a cylindrical body with a plurality of alphanumeric character is and a sequence of marks, including an index mark and a plurality of timing marks, uniformly disposed about the circumference of the body, the timing marks being in relative alignment with the characters such that each character is associated with a pair of timing marks, the index mark designating a start location on the body, the method comprising the steps of:

positioning a detector proximate to the drum;

detecting, upon rotation of the drum, the index mark and at least one pair of timing marks;

producing a digital signal representative of the detecting marks;

determining, according to the digital signal, the position on the drum of the character associated with the detected pair, and determining the angular velocity of the drum based on elapsed time between the detected marks.

2. The method of claim 1 where the step of detecting includes the step of magnetically sensing the marks and producing an analog signal representative of the marks.

3. The method of claim 2 where the step of detecting also includes the step of converting the analog signal to a digital signal.

4. The method of claim 2 where the step of magnetically sensing includes the step of generating a magnetic field.

5. The method of claim 4 where the step of magnetically sensing also includes the step of directing the magnetic field toward the marks.

6. The method of claim 5 where the step of magnetically sensing further includes the step of detecting changes in the magnetic field produced by rotation of the drum and producing an analog signal representative of the changes.

7. The method of claim 3 where the step of converting includes the step of producing an amplified signal from the analog signal.

8. The method of claim 7 where the step of converting also includes the step of detecting zero-crossings of the amplified signal and producing a digital signal.

9. The method of claim 1 where the step of determining position includes the step of counting each digital signal and producing a count.

10. The method of claim 9 where the step of determining position also includes the step of referencing the count to a table of predetermined characters.

11. The method of claim 1 where the step of determining angular velocity includes the step of determining the elapsed time between the detected timing marks.

12. The method of claim 1 where the step of determining angular velocity includes the step of determining the lapsed time between successive detections of the index mark.

13. A method of determining the position and velocity of a print medium, the medium having thereon a plurality of alphanumeric characters and a sequence of marks, including an index mark and a plurality of timing marks, uniformly disposed along a selected dimension of the medium, said timing marks being in relative alignment with the characters such that each character is associated with a pair of timing marks, said index mark designating a start location on the medium, the method comprising the steps of:

positioning a detector proximate to the medium;

detecting, upon movement of the medium along the selected dimension, the index mark and at least one pair of timing marks, producing a digital signal representative of the detected marks; and determining, according to the digital signal, the position on the medium of the character associated with the detected pair, and determining the velocity of the medium based on elapsed time between the detected timing marks.

14. The apparatus of claim 3 wherein the processor means determines the angular velocity of the drum based on elapsed time between the detected timing marks.

15. The apparatus of claim 3 wherein the processor means determines the angular velocity of the drum based on elapsed time between successive detections of the index mark.

16. An apparatus for determining position and velocity of a print medium, the apparatus comprising:

detector means disposed proximate to the medium;

said medium having thereon a plurality of alphanumeric characters and a sequence of marks, including an index mark and a plurality of timing marks, uniformly disposed along a selected dimension of the medium, said timing marks being in relative alignment with the characters such that each character is associated with a pair of timing marks, said index mark designating a start location on the medium;

said detector means being responsive to movement of the medium along the selected dimension for detecting the index mark and at least one pair of timing marks, and producing a digital signal representative of the detected marks; and processor means coupled to said detector means and responsive to said digital signal for determining the position on the medium of the character associated with the detected pair, and determining the velocity of the medium based on elapsed time between the detected marks.

17. The apparatus of claim 16 wherein the processor means determines the angular velocity of the drum based on elapsed time between the detected timing marks.

18. The apparatus of claim 16 wherein the processor means determines the angular velocity of the drum based on elapsed time between successive detections of the index mark.

19. An apparatus for determining position and angular velocity of a print drum, the apparatus comprising:

detector means disposed proximate to the drum;

said drum having a cylindrical body with a plurality of alphanumeric characters and a sequence of marks, including an index mark and a plurality of timing marks, uniformly disposed about the circumference of the body, said timing marks being in relative alignment with the characters such that each character is associated with a pair of timing marks, said index mark designating a start location on the body;

said detector means being responsive to rotation of the drum for detecting the index mark and at least one pair of timing marks, and producing a digital signal representative of the detected marks; and processor means coupled to said detector means and responsive to said digital signal for determining the position on the drum of the character associated with the detected pair, and determining the angular velocity of the drum based on elapsed time between detected marks.

20. The apparatus as in claim 19 wherein the detector means includes a sensor means for sensing the marks, and producing an analog signal representative of the marks.

21. The apparatus as in claim 20 wherein the detector means also includes a signal conversion means responsive to the analog signal for converting said analog signal to a digital signal.

22. The apparatus as in claim 21 wherein the sensor means includes a magnetic field generating means for generating a magnetic field.

23. The apparatus as in claim 22 wherein the magnetic field generating means is a magnet.

24. The apparatus as in claim 23 wherein the sensor means also includes a magnetic lens disposed proximate to the magnet and to the marks for directing the magnetic field toward said marks.

25. The apparatus as in claim 24 wherein the sensor means further includes a hall effect sensing means disposed proximate to the magnetic lens and to said marks for detecting changes in magnetic field produced by rotation of the drum, and for producing an analog signal representative of said changes.

26. The apparatus as in claim 25 wherein the signal conversion means includes amplification means coupled to the hall effect sensing means and responsive to the analog signal for producing an amplified signal.

27. The apparatus as in claim 26 wherein the signal conversion means also includes a zero-crossing detector circuit means coupled to the amplification means and responsive to the amplified signal for producing a digital signal.

28. A print drum comprising:

a cylindrical body having a plurality of sequence of alphanumeric characters; and a sequence of marks, including an index mark and a plurality of timing marks, uniformly disposed about the circumference of the body, the timing marks being in relative alignment with the characters such that each character is associated with a pair of time marks and the index mark designates a start location on the body, the timing marks having a first predetermined width, and the index mark having a second predetermined width different from the first predetermined width, said sequence and widths of the marks being detectable by a detector.

29. The print drum of claim 28 wherein the second predetermined width is wider than the first predetermined width.

30. The print drum of claim 29 wherein the timing marks are arranged relative to the characters such that each character is aligned with a pair of timing marks.

31. The print drum of claim 30 wherein, upon detection of a pair of timing marks, the character aligned with the detected pair becomes positioned for printing.

32. The print drum of claim 31 wherein the timing marks are disposed such that angular velocity of the drum can be determined based on elapsed time between detections of the marks.

* * * * *

UNITED STATES PATENT AND TRADEMARK OFFICE

CERTIFICATE OF CORRECTION

PATENT NO. : 5,178,070

DATED : January 12, 1993

INVENTOR(S) : Donald Zorn et al.

It is certified that error appears in the above-identified patent and that said Letters Patent is hereby corrected as shown below:

Column 4, line 63, "character" should be --characters--.

Column 8, line 2, "sequence" should be --sequences--.

Signed and Sealed this

Second Day of November, 1993

Bruce Lehman

*Attest:*

BRUCE LEHMAN

*Attesting Officer*

*Commissioner of Patents and Trademarks*